US006362613B1

(12) United States Patent
Rodriguez

(10) Patent No.: US 6,362,613 B1
(45) Date of Patent: Mar. 26, 2002

(54) INTEGRATED CIRCUIT WITH IMPROVED CURRENT MIRROR IMPEDANCE AND METHOD OF OPERATION

(75) Inventor: David Rodriguez, Phoenix, AZ (US)

(73) Assignee: Gain Technology Corporation, Tucson, AZ (US)

( * ) Notice: Subject to any disclaimer, the term of this patent is extended or adjusted under 35 U.S.C. 154(b) by 0 days.

(21) Appl. No.: 09/711,482

(22) Filed: Nov. 13, 2000

(51) Int. Cl.[7] ..... G05F 3/16; G05F 3/20
(52) U.S. Cl. ..... 323/315; 323/314; 323/317
(58) Field of Search ..... 323/313, 314, 323/315, 316, 317

(56) References Cited

U.S. PATENT DOCUMENTS 4,943,736 A * 7/1990 Kihara et al. ..... 307/261
5,325,045 A * 6/1994 Sundby ..... 323/313
5,495,166 A * 2/1996 Alini et al. ..... 323/314
5,563,504 A * 10/1996 Gilbert et al. ..... 323/316
5,572,161 A * 11/1996 Myers ..... 327/538
5,838,192 A * 11/1998 Bowers et al. ..... 327/541
5,867,014 A * 2/1999 Wrathall et al. ..... 323/316
5,973,550 A * 10/1999 Bowers et al. ..... 327/541
6,121,764 A 9/2000 Stockstad ..... 323/315
6,232,753 B1 * 5/2001 Pasotti et al. ..... 323/267
6,232,757 B1 * 5/2001 Afghahi et al. ..... 323/314

* cited by examiner

*Primary Examiner*—Bao Q. Vu
(74) *Attorney, Agent, or Firm*—Bryan Cave LLP

(57) ABSTRACT

An integrated circuit (200, 300, 500) includes a current mirror having high output impedance and also having an output device with a low drain-to-source saturation voltage.

37 Claims, 5 Drawing Sheets

INTEGRATED CIRCUIT WITH IMPROVED CURRENT MIRROR IMPEDANCE AND METHOD OF OPERATION

FIELD OF THE INVENTION

This invention relates to electronics, in general, and to integrated circuits and methods of operation, in particular.

BACKGROUND OF THE INVENTION

Phase Lock Loops (PLLs) are used in a wide variety of electronic applications. In general, a PLL has a phase frequency detector, also known as a phase detector, a charge pump, a loop filter, a Voltage-Controlled Oscillator (VCO), and a clock divider. Low output impedances of current sources in the charge pump cause several problems including phase offset, phase noise, and jitter due to the resulting mismatch in up and down currents into the loop filter. Cascoding techniques can be used to increase output impedance, but the resulting high drain-to-source saturation voltages in output transistors of the charge pump also cause several problems including decreased output dynamic range. Similarly a Metal-Oxide-Semiconductor (MOS) output device in the current source can be made with a long channel length to increase output impedance, but the long channel length adds to the capacitance of the circuit. The higher capacitance reduces the speed of the circuit, but higher speeds are required in applications such as a PLL charge pump.

Accordingly, a need exists for an integrated circuit comprised of a fast current source with a high output impedance and low output drain-to-source saturation voltages.

SUMMARY OF THE INVENTION

In accordance with the principles of the invention, a first embodiment of an integrated circuit comprises a first three-terminal device; a second three-terminal device; a third three-terminal device, a first terminal of the third three-terminal device coupled to first terminals of the first and second three-terminal devices, a second terminal of the third three-terminal device coupled to second terminals of the first and second three-terminal devices and to a third terminal of the third three-terminal device; a fourth three-terminal device; an amplifier comprising two inputs and an output, a first one of the two inputs coupled to a first terminal of the fourth three-terminal device and to a third terminal of the second three-terminal device, a second one of the two inputs coupled to a third terminal of the first three-terminal device, the output coupled to a second terminal of the fourth three-terminal device; a first current source comprising an output; a second current source comprising an output coupled to the output of the first current source and to a third terminal of the fourth three-terminal device; and a fifth three-terminal device, a first terminal of the fifth three-terminal device coupled to the output of the first current source, a third terminal of the fifth three-terminal device coupled to the third terminal of the third three-terminal device.

Further, in accordance with the principles of the invention, a second embodiment of the integrated circuit comprises a first n-channel MOSFET comprising first source, gate, and drain electrodes; a second n-channel MOSFET comprising second source, gate, and drain electrodes; a third n-channel MOSFET comprising third source, gate, and drain electrodes, the first, second, and third source electrodes coupled to each other, the first, second, and third gate electrodes coupled to each other and to the third drain electrode; a fourth n-channel MOSFET comprising fourth source, gate, and drain electrodes, the fourth source electrode coupled to the second drain electrode; an amplifier comprising negative and positive inputs and an output, the negative input coupled to the fourth source electrode and to the second drain electrode, the positive input coupled to the first drain electrode, the output coupled to the fourth gate electrode; a first current source comprising an output coupled to the fourth drain electrode; a second current source comprising an output coupled to the fourth drain electrode and to the output of the first current source; and a first p-channel MOSFET comprising fifth source, gate, and drain electrodes, the fifth source electrode coupled to the outputs of the first and second current sources and to the fourth drain electrode, the fifth drain electrode coupled to the third drain electrode and to the first, second, and third gate electrodes.

Still further, in accordance with the principles of the invention, an embodiment of a method of operating an integrated circuit comprises providing a first current; generating a second current to replicate the first current; generating a reference current; subtracting the second current from the reference current to create a net current; and adjusting a value of the net current.

BRIEF DESCRIPTION OF THE DRAWINGS

The invention will be better understood from a reading of the following detailed description, taken in conjunction with the accompanying drawing figures in which.

Figure 1:
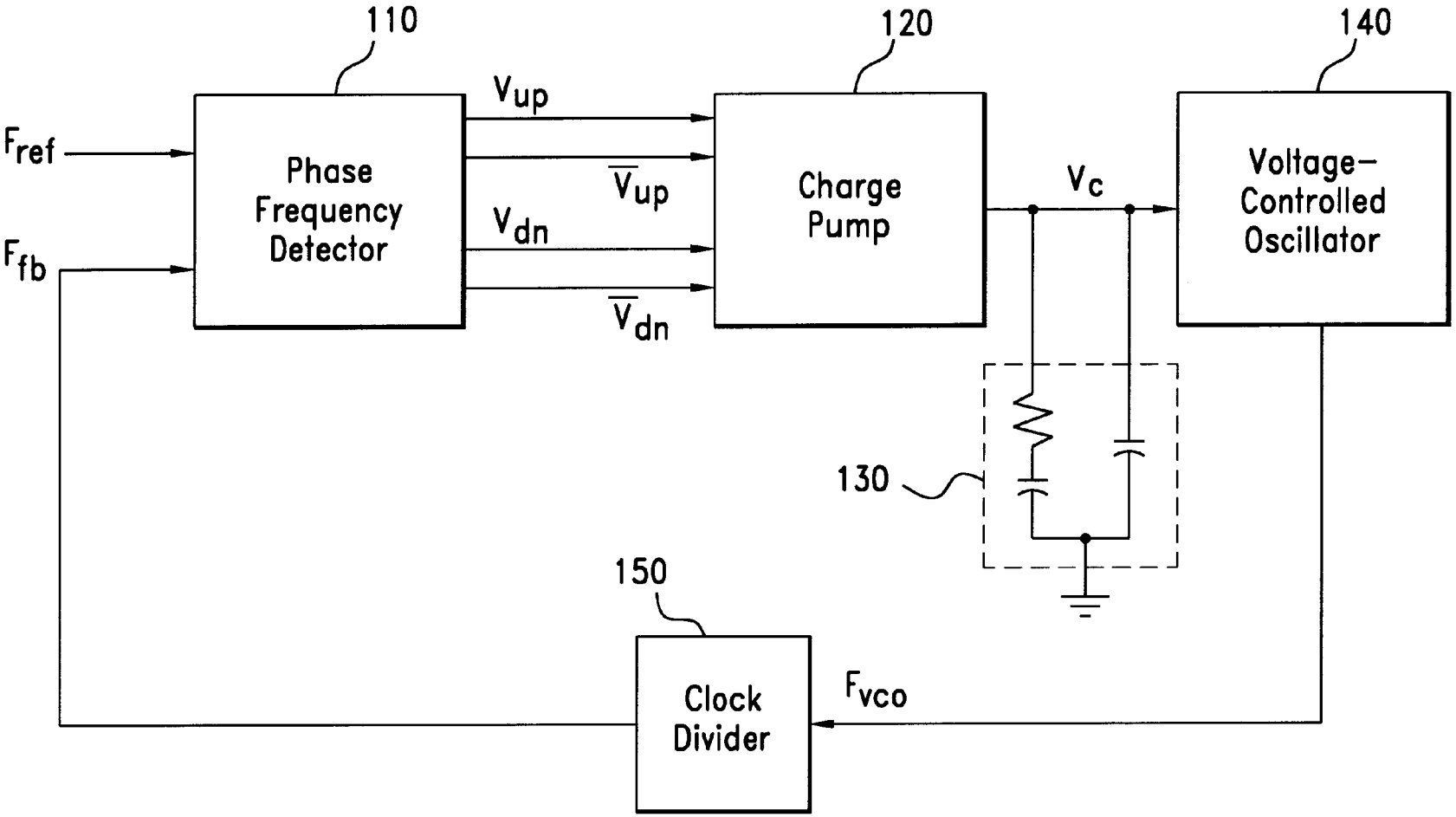
FIG. 1 illustrates a block diagram of an integrated circuit in accordance with a present embodiment of the invention.

For simplicity and clarity of illustration, the drawing figures illustrate the general manner of construction, and descriptions and details of well-known features and techniques are omitted to avoid unnecessarily obscuring the invention. Additionally, elements in the drawing figures are not necessarily drawn to scale, and the same reference numerals in different figures denote the same elements.

Furthermore, the terms first, second, third, fourth, and the like in the description and in the claims, if any, are used for distinguishing between similar elements and not necessarily for describing a sequential or chronological order. It is further understood that the terms so used are interchangeable under appropriate circumstances and that the embodiments of the invention described herein are capable of operation in other sequences than described or illustrated herein.

DETAILED DESCRIPTION OF THE DRAWINGS

FIG. 1 illustrates a block diagram of an integrated circuit 100. In the preferred embodiment, circuit 100 comprises a Phase Lock Loop (PLL). As illustrated in FIG. 1, circuit 100 comprises a phase frequency detector 110, a charge pump 120, a loop filter 130, a Voltage-Controlled Oscillator (VCO) 140, and a clock divider 150.

Phase frequency detector 110 compares the frequency of two signals, namely a reference frequency ($F_{ref}$) and a feedback frequency ($F_{fb}$). Based on its comparison, phase frequency detector 110 outputs control signals to charge pump 120. As an example, the control signals can include an up voltage signal and a down voltage signal. The up voltage signal can be transmitted by a differential voltage signal, namely a $V_{up}$ signal and a $\overline{V}_{up}$ signal, and the down voltage signal can also be transmitted by a differential voltage signal, namely a $V_{dn}$ signal and a $\overline{V}_{dn}$ signal.

In response to the control signals received from phase frequency detector 110, charge pump 120 generates an output current. The output current can increase or maintain a charge in the capacitors in loop filter 130, or the output current can deplete a charge in the capacitors in loop filter 130. The charge of the capacitors in loop filter 130 determine a control voltage ($V_c$) that controls VCO 140. The output current used to increase or maintain the charge of the capacitors within portion 130 is referred to as an up current. The output current that is used to decrease the charge of the capacitors within portion 130 is referred to as a down current.

In response to the control voltage, VCO 140 generates a signal with the VCO frequency ($F_{vco}$). The signal with the VCO frequency ($F_{vco}$) is transmitted to clock divider 150, which in turn generates the feedback frequency ($F_{fb}$). The signal with the feedback frequency ($F_{fb}$) is transmitted back to frequency detector 110. This process can be repeated many times until the feedback frequency ($F_{fb}$) is approximately equal to the reference frequency ($F_{ref}$).

Figure 2:
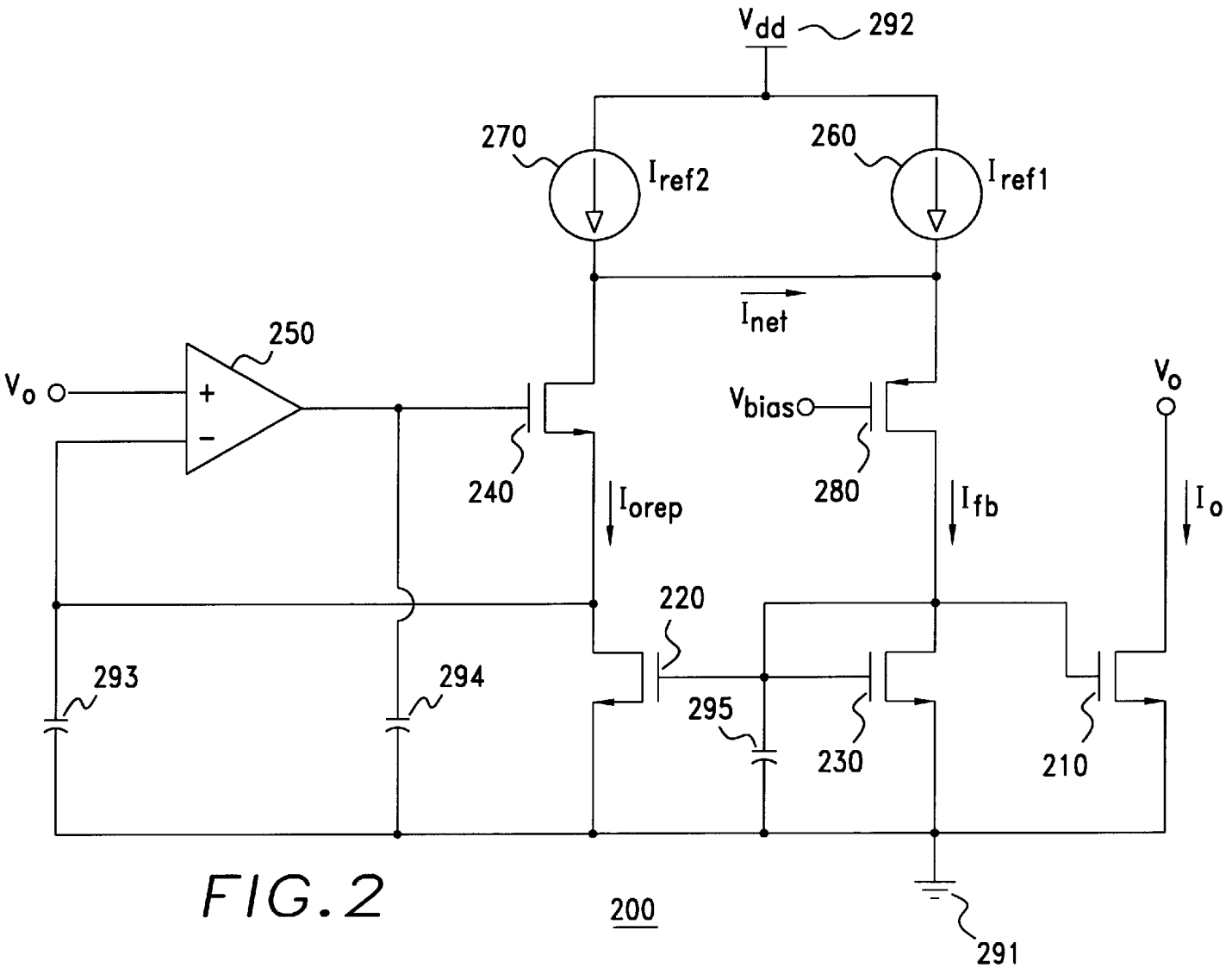
FIG. 2 illustrates a circuit diagram of a portion of the integrated circuit of FIG. 1 in accordance with an embodiment of the invention.

FIG. 2 illustrates a circuit diagram of a circuit 200, which is a portion of charge pump 120 in FIG. 1. In the preferred embodiment, circuit 200 in FIG. 2 represents a down current portion of charge pump 120 in FIG. 1. One skilled in the art will understand that circuit 200 includes a current mirror.

Circuit 200 in FIG. 2 comprises, among other elements, a three-terminal device 210 of a first type. As an example, the first type of three-terminal device, such as device 210, can be a Field-Effect Transistor (FET) or a bipolar transistor. The FET can be a Metal-Oxide-Semiconductor FET (MOSFET), a Junction FET (JFET), or a MEtal-Semiconductor FET (MESFET). The FET can also be an enhancement, depletion, or native device. The three terminals of a FET are a source electrode, a gate electrode, and a drain electrode. The three terminals of a bipolar transistor are an emitter electrode, a base electrode, and a collector electrode. The gate electrode of a FET is its control electrode, and the base electrode of a bipolar transistor is its control electrode. In the preferred embodiment, the first type of three-terminal device, such as device 210, is an n-channel MOSFET. Accordingly, in the preferred embodiment, device 210 has a source electrode, a gate electrode, and a drain electrode where the gate electrode is the control electrode or control terminal for device 210.

The term "three-terminal device" is defined as a device having at least three terminals. Therefore, the three-terminal device can also have four terminals. For example, the three-terminal device can be a FET with an additional bulk or backgate electrode that is coupled to a voltage potential. In the preferred embodiment, the bulk electrode, when used, is coupled to a ground potential, to the source electrode for an n-channel MOSFET, or to the source electrode or the positive supply rail for a p-channel MOSFET.

Circuit 200 further comprises a three-terminal device 220 of the first type. A first terminal, or source electrode, of device 220 is coupled to a first terminal, or a source electrode, of device 210. A second terminal, or gate electrode, of device 220 is coupled to a second terminal, or gate electrode, of device 210. The term "coupled" is defined as directly or indirectly connected in an electrical manner.

Circuit 200 also comprises a three-terminal device 230 of the first type. Al first terminal, or source electrode, of device 230 is coupled to the first terminals of devices 210 and 220. The first terminals of devices 210, 220, and 230 are each coupled to a ground potential 291. A second terminal, or gate electrode, of device 230 is coupled to the second terminals of devices 210 and 220. The second terminals of devices 210, 220, and 230 are coupled to a third terminal, or drain electrode, of device 230. In the preferred embodiment, devices 210 and 220 are larger than device 230. For example, each of devices 210 and 220 can be approximately five times larger than device 230.

Circuit 200 further comprises a device 240 of the first type. A first terminal, or source electrode, of device 240 is coupled to a third terminal, or drain electrode, of device 220.

Circuit 200 additionally comprises an amplifier 250. Amplifier 250 has an output and also has two inputs, namely a negative input and a positive input. The output and the negative input of amplifier 250 are coupled to form a negative feedback loop using device 240. In particular, the output of amplifier 250 is coupled to a second terminal, or gate electrode, of device 240, and the negative input of amplifier 250 is coupled to the first terminal of device 240. The second terminal of device 240 has a high input impedance. The negative input of amplifier 250 is also coupled to the third terminal of device 220.

The positive input of amplifier 250 is coupled to an output voltage ($V_o$) of circuit 200. A third terminal, or drain electrode, of device 210 is also coupled to the output voltage ($V_o$) of circuit 200. Accordingly, the positive input of amplifier 250 is coupled to the third terminal of device 210.

In the preferred embodiment, amplifier 250 is an Operational Transconductance Amplifier (OTA). The OTA provides voltage gain for the aforementioned negative feedback loop. In the preferred embodiment, amplifier 250 does not require a buffer stage because amplifier 250 drives the high impedance second terminal of device 240. If the second terminal of device 240 requires additional capability, however, an operational amplifier that includes a gain stage and a buffer stage may be used for amplifier 250.

Circuit 200 further comprises a current source 260. Current source 260 comprises an output coupled to a third terminal, or drain electrode, of device 240. Current source 260 generates a reference current ($I_{ref1}$). In the preferred embodiment, current source 260 has very high output impedance similar to an ideal current source.

Circuit 200 additionally comprises a current source 270. Current source 270 comprises an output coupled to the output of current source 260 and the third terminal of device 240. Current source 270 generates another reference current ($I_{ref2}$). In the preferred embodiment, current source 270 has a very high output impedance similar to an ideal current source.

Current sources 260 and 270 are coupled to a substantially constant voltage provided by a power supply ($V_{dd}$) 292. In the preferred embodiment, current source 260 generates a current that is smaller than a current generated by current source 270. For example, the reference current ($I_{ref1}$) generated by current source 260 can be approximately five times smaller than the reference current ($I_{ref2}$) generated by current source 270. For instance, the reference currents generated by current sources 260 and 270 can be approximately 20 and 100 microAmperes, respectively.

Circuit 200 still further comprises a three-terminal device 280 of a second type. As an example, the second type of three-terminal device, such as device 280, can be a FET or a bipolar transistor. The FET can be a MOSFET, a JFET, or a MESFET. In the preferred embodiment, the second type of three-terminal device, such as device 280, is a p-channel MOSFET and is a cascode device. Device 280 can also be the first type of three-terminal device if its source and drain electrodes were reversed, and device 240 can also be the second type of three-terminal device if its source and drain electrodes were reversed.

A first terminal, or source electrode, of device 280 is coupled to the output of current source 260, the output of current source 270, and the third terminal of device 240. A second terminal, or gate electrode, of device 280 is coupled to a bias voltage ($V_{bias}$). A third terminal, or drain electrode, of device 280 is coupled to the third terminal of device 230 and the second terminals of devices 210, 220, and 230.

Circuit 200 can also comprise an optional capacitor 293. Capacitor 293 couples the negative input of amplifier 250, the first terminal of device 240, and the third terminal of device 220 to the first terminals of devices 210, 220, and 230 and also to ground potential 291.

Circuit 200 can further comprise an optional capacitor 294. Capacitor 294 couples the output of amplifier 250 and the second terminal of device 240 to the first terminals of devices 210, 220, and 230 and also to ground potential 291.

Circuit 200 can further comprise an optional capacitor 295. Capacitor 295 couples the third terminals of devices 230 and 280 and the second terminals of devices 210, 220, and 230 to the first terminals of devices 210, 220, and 230 and also to ground potential 291. In the preferred embodiment, each of capacitors 293, 294, and 295 are comprised of a FET where the source and drain electrodes of the FET are electrically shorted together.

During the operation of circuit 200, device 210 generates an output current ($I_o$). In response to the generation of the output current ($I_o$) by device 210, device 220 mirrors or generates a replica of the output current ($I_{orep}$). The replica output current ($I_{orep}$) is compared to the second reference current ($I_{ref2}$). The difference between the second reference current and the replica output current is an error current, a differential current, or a net current ($I_{net}$) The net current ($I_{net}$) can be positive, negative, or zero. A positive net current ($+I_{net}$) indicates that the net current ($I_{net}$) flows in the direction of the net current arrow in FIG. 2 and also indicates that the second reference current ($I_{ref2}$) is larger than the replica output current ($I_{orep}$) A negative net current ($-I_{net}$) indicates that the net current ($I_{net}$) flows in a direction opposite to the net current arrow in FIG. 2 and also indicates that the replica output current ($I_{orep}$) is greater than the second reference current ($I_{ref2}$). Most of the difference between the second reference current ($I_{ref2}$) and the replica output current ($I_{orep}$) is due to the output impedance of device 220 and also to the saturated drain-to-source voltage effect of device 220. Low output impedance tends to make the net current ($I_{net}$) become more negative, while saturating device 220 tends to make the net current ($I_{net}$) become more positive. The net current ($I_{net}$) can be positive, negative, or zero while maintaining the feedback path. There is no need to scale devices or induce offsets in the feedback loop specifically to keep the feedback path active.

The net current ($I_{net}$) is added to the first reference current ($I_{ref1}$) to produce a feedback current ($I_{fb}$). If the net current ($I_{net}$) is positive, the feedback current ($I_{fb}$) will be larger than the first reference current ($I_{ref1}$). If, however, the net current ($I_{net}$) is negative, then the first reference current ($I_{ref1}$) will be larger than the feedback current ($I_{fb}$). Device 280 is biased by the bias voltage ($V_{bias}$) to be turned on. Thus, device 230 receives the feedback current.

The feedback current is replicated by devices 210 and 220 to change the output current ($I_o$) and the replica of the output current ($I_{orep}$) The revised replica output current ($I_{orep}$) is compared to the second reference current ($I_{ref2}$), and a new net current ($I_{net}$) is generated. This new net current ($I_{net}$) is added to the first reference current ($I_{ref1}$). The addition of these currents creates a new feedback current ($I_{fb}$).

This feedback loop process continues until the net current ($I_{net}$) has been reduced by a factor of "N+1," where "N" is the ratio of ($I_{ref2}$) to ($I_{ref1}$) and of ($I_{orep}$) to ($I_{fb}$). The use of this feedback loop improves the output impedance of charge pump 120 in FIG. 1. In particular, the effective output impedances of devices 210 and 220 in FIG. 2 are reduced.

The feedback loop of circuit 200 also advantageously reduces the effective drain-to-source saturation voltages of the output devices in the current mirror of circuit 200. As the voltages on the third terminals of devices 210 and 220, which generate ($I_o$) and ($I_{orep}$), begin to drop below the drain-to-source saturation voltages of devices 210 and 220, the net current ($I_{net}$) increases and is added to the first reference current ($I_{ref1}$). The addition of these two currents creates a new feedback current ($I_{fb}$). The feedback current ($I_{fb}$) is replicated by devices 210 and 220 to change the output current ($I_o$) and the replica output current ($I_{orep}$). The replication of the feedback current ($I_{fb}$) by devices 210 and 220 is now, however, less accurate because devices 210 and 220 are operating in the triode region while device 230 is operating in the saturation region. The revised replica output current ($I_{orep}$) is compared to the second reference current ($I_{ref2}$), and a new net current ($I_{net}$) is generated. This feedback loop process continues until the net current ($I_{net}$) has been reduced to compensate for the difference between the second reference current ($I_{ref2}$) and the replica output current ($I_{orep}$) and is limited by the value of the reference currents ($I_{ref1}$ and $I_{ref2}$) In particular, the effective drain-to-source saturation voltages of devices 210 and 220 are closer to zero volts such that the dynamic range of the current mirror is increased.

Accordingly, a current flowing out of the third terminal of device 280 and into the third terminal of device 230 is approximately equal to a current flowing out of the output of current source 260 plus a current flowing out of the output of current source 270 minus a current flowing into the third terminal of device 240. Expressed in a different way, $$I_{ref1}+I_{ref2}=I_{orep}+I_{fb} \quad \text{Equation 1}$$

where $$I_{ref2}=N\times I_{ref1} \quad \text{Equation 2}$$

and $$I_{orep} = N \times I_{fb} + \frac{V_o}{R_o} \quad \text{Equation 3}$$

where N represents the scaling factor between devices 210 and 230, between devices 220 and 230, and between current sources 270 and 260. Solving for $I_o$, $$I_o = I_{orep} = N \times I_{ref1} + \frac{V_o}{(N+1) \times R_o} \quad \text{Equation 4}$$

which shows the improvement in output impedance of the current mirror. In particular, the effective output impedance of the output device, or device 210, in the current mirror is increased by a factor of "N +1".

Similarly, $$I_{net} = I_{ref2} - I_{orep} \quad \text{Equation 5}$$

where $$I_{orep} = N \times I_{fb} + \frac{V_o}{R_o} \quad \text{Equation 6}$$

$$I_{net} = I_{ref2} - N \times (I_{ref1} + I_{net}) - \frac{V_o}{R_o} \quad \text{Equation 7}$$

$$I_{net} = \frac{I_{ref2}}{N+1} - \frac{N \times I_{ref}}{N+1} - \frac{V_o}{(N+1) \times R_o} \quad \text{Equation 8}$$

and $$I_{ref2} = N \times I_{ref1} \quad \text{Equation 9}$$

so $$I_{net} = \frac{-V_o}{(N+1) \times R_o} \quad \text{Equation 10}$$

which shows the final value to which the loop converges.

Capacitor 293 can be included in circuit 200 to compensate the voltage-follower output of amplifier 250 and to keep the gain of the voltage follower, comprised of device 240, from peaking. Capacitor 294 can also be included in circuit 200 to compensate the output of amplifier 250. Capacitors 294 and 293 are the primary and secondary compensation elements, respectively, for amplifier 250. Capacitor 295 can be included in circuit 200 to compensate the aforementioned feedback loop and to filter noise from ground potential 291.

Figure 3:
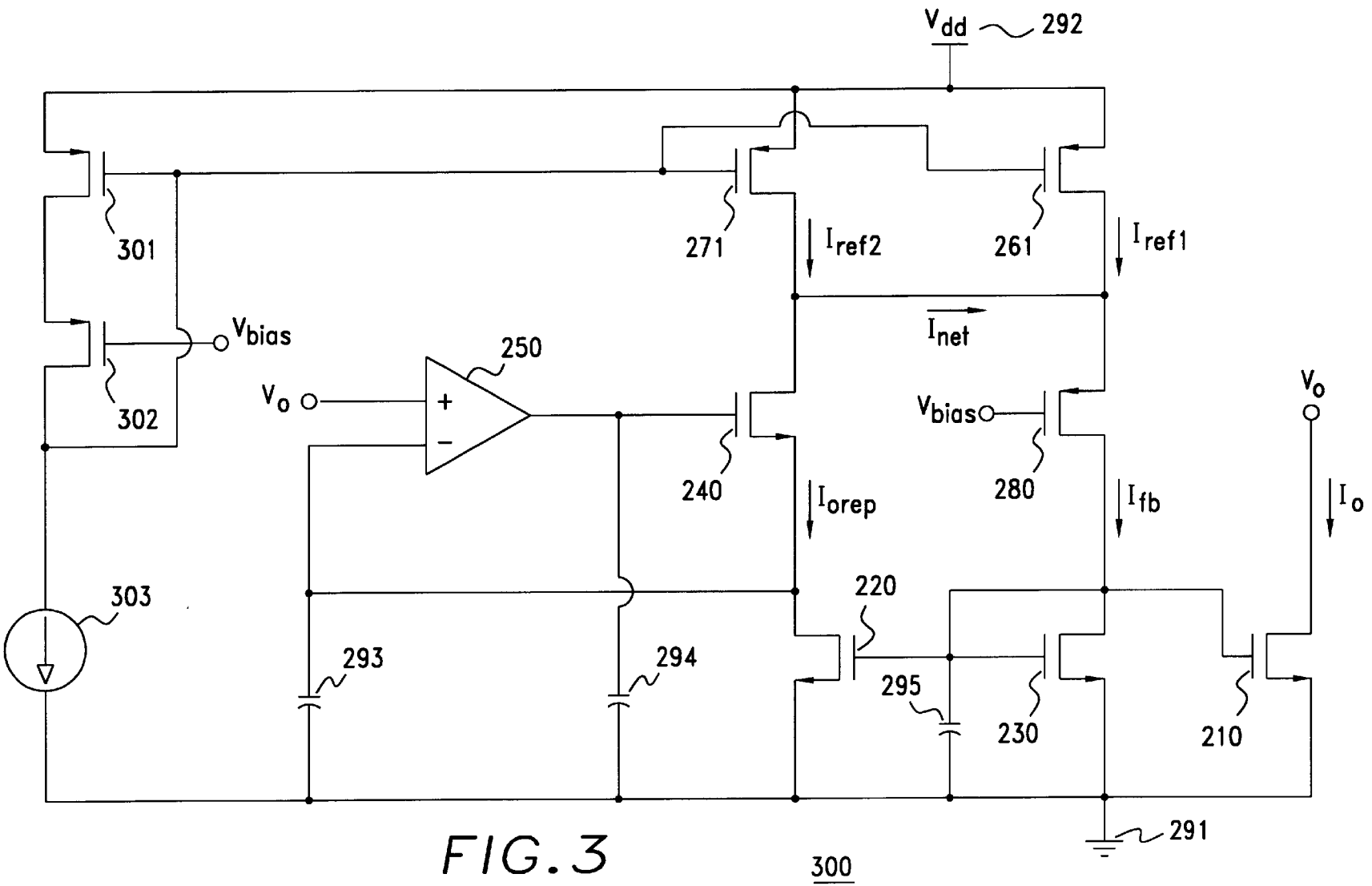
FIG. 3 illustrates a more detailed circuit diagram of the portion of the integrated circuit of FIG. 1 in accordance with an embodiment of the invention.

FIG. 3 illustrates a circuit diagram of a circuit 300. Circuit 300 in FIG. 3 is a more detailed view of circuit 200 in FIG. 2. In particular, circuit 300 in FIG. 3 comprises three-terminal devices 210, 220, 230, 240, and 280, amplifier 250, capacitors 293, 294, and 295, power supply ($V_{dd}$) 292, and ground potential 291 of circuit 200 in FIG. 2.

Current sources 260 and 270 of circuit 200 in FIG. 2 are illustrated in more detail in circuit 300 in FIG. 3. In particular, current source 303 and three-terminal devices 261, 271, 301, 20 and 302 are illustrated in circuit 300 in FIG. 3. A second terminal, or gate electrode, of device 302 is biased by the bias voltage ($V_{bias}$). Current source 260 in FIG. 2 comprises, among other elements, device 261 in FIG. 3. Current source 270 in FIG. 2 comprises, among other elements, device 271 in FIG. 3.

In the preferred embodiment, device 301 is approximately the same size as device 261. Also, in the preferred embodiment, device 271 is larger than device 261. For example, device 271 can be approximately five times larger than device 261. In this embodiment, the reference current ($I_{ref2}$) generated by current source 270 (FIG. 2) will be approximately five times larger than the reference current ($I_{ref1}$) generated by current source 260 (FIG. 2). When the feedback current ($I_{fb}$) is replicated by devices 210 and 220, the currents generated by devices 210 and 220 are approximately five times as large as the feedback current ($I_{fb}$) because, as indicated earlier, devices 210 and 220 are preferably five times as large as device 230.

Figure 4:
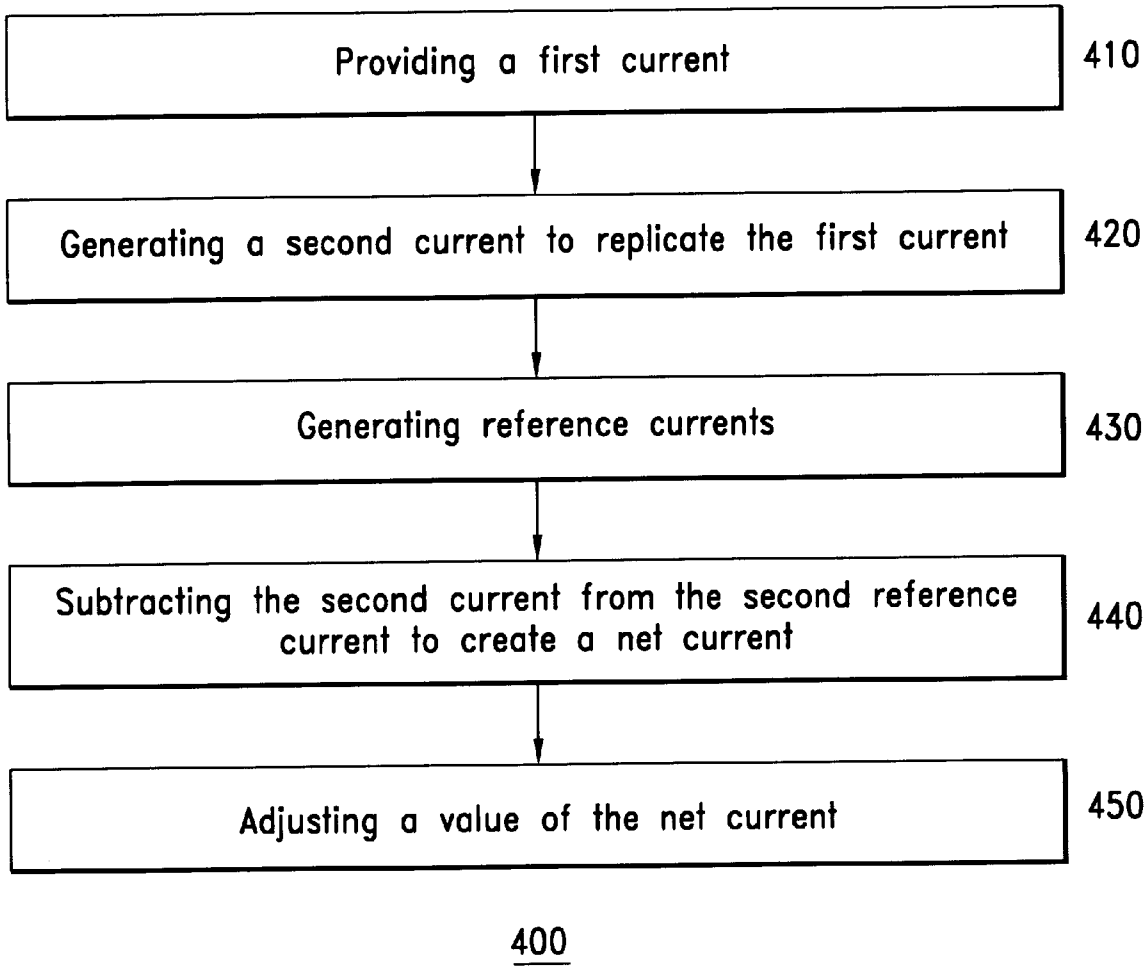
FIG. 4 illustrates a method of operating the portion of the integrated circuit of FIG. 1 in accordance with an embodiment of the invention.

FIG. 4 illustrates a flowchart 400 of a method of operating an integrated circuit. In general, the integrated circuit can be similar to a portion of integrated circuit 100 of FIG. 1. In particular, the method described in flowchart 400 of FIG. 4 can describe the operation of circuits 200 and 300 in FIGS. 2 and 3, respectively.

At a step 410 of flowchart 400 in FIG. 4, a first current is provided, generated, or monitored. As an example, the first current of step 410 can be similar to the output current ($I_o$) of FIG. 2. Next, at a step 420 of flowchart 400 in FIG. 4, a second current is generated to replicate the first current. As an example, the second current of step 420 can be similar to the replica output current ($I_{orep}$) of FIG. 2.

At a step 430 of flowchart 400 in FIG. 4, reference currents are generated. As an example, a first one of the reference currents of step 430 can be similar to the first reference current ($I_{ref1}$), and second one of the reference currents of step 430 can be similar to the second reference current ($I_{ref2}$) of FIG. 2. At a step 440 of flowchart 400 in FIG. 4, the second current is subtracted from the second reference current to create a positive, negative, or zero net current. As an example, the net current of step 440 can be similar to the net current ($I_{net}$) of FIG. 2.

At a step 450 of flowchart 400 in FIG. 4, the value of the net current is adjusted. Preferably, the value of the net current is adjusted towards a predetermined value. As an example, the predetermined value of the net current can be determined by Equation 10.

Step 450 can be performed according to the following description. First, the net current can be added to the first reference current to create a feedback current. As an example, the feedback current can be similar to the feedback current ($I_{fb}$) of FIG. 2. Next, if the net current is greater than the predetermined value, the first and second currents of steps 410 and 420, respectively, are increased. After increasing the first and second currents, the value of the net current is closer to the predetermined value. If, however, the net current is less than the predetermined value, then the first and second currents of steps 410 and 420, respectively, are decreased. After decreasing the first and second currents, the value of the net current is also closer to the predetermined value.

The performance of step 450 in flowchart 400 of FIG. 4 can also be described as follows. First, the net current can be added to the first reference current to create a feedback current. As an example, the feedback current can be similar to the feedback current ($I_{fb}$) of FIG. 2. Next, the first and second currents of steps 410 and 420, respectively, are adjusted to replicate an equal or larger scaled version of the feedback current. After adjusting the first and second currents, the second current is subtracted from the second reference current to create a different net current. The value of the different net current is closer to the predetermined value than the original net current of step 440. Then, the different net current is added to the first reference current to create a different feedback current. Subsequently, the first and second currents are adjusted to replicate an equal or larger scaled version of the different feedback current. These steps are repeated until the resulting net current is approximately equal to the predetermined value.

Figure 5:
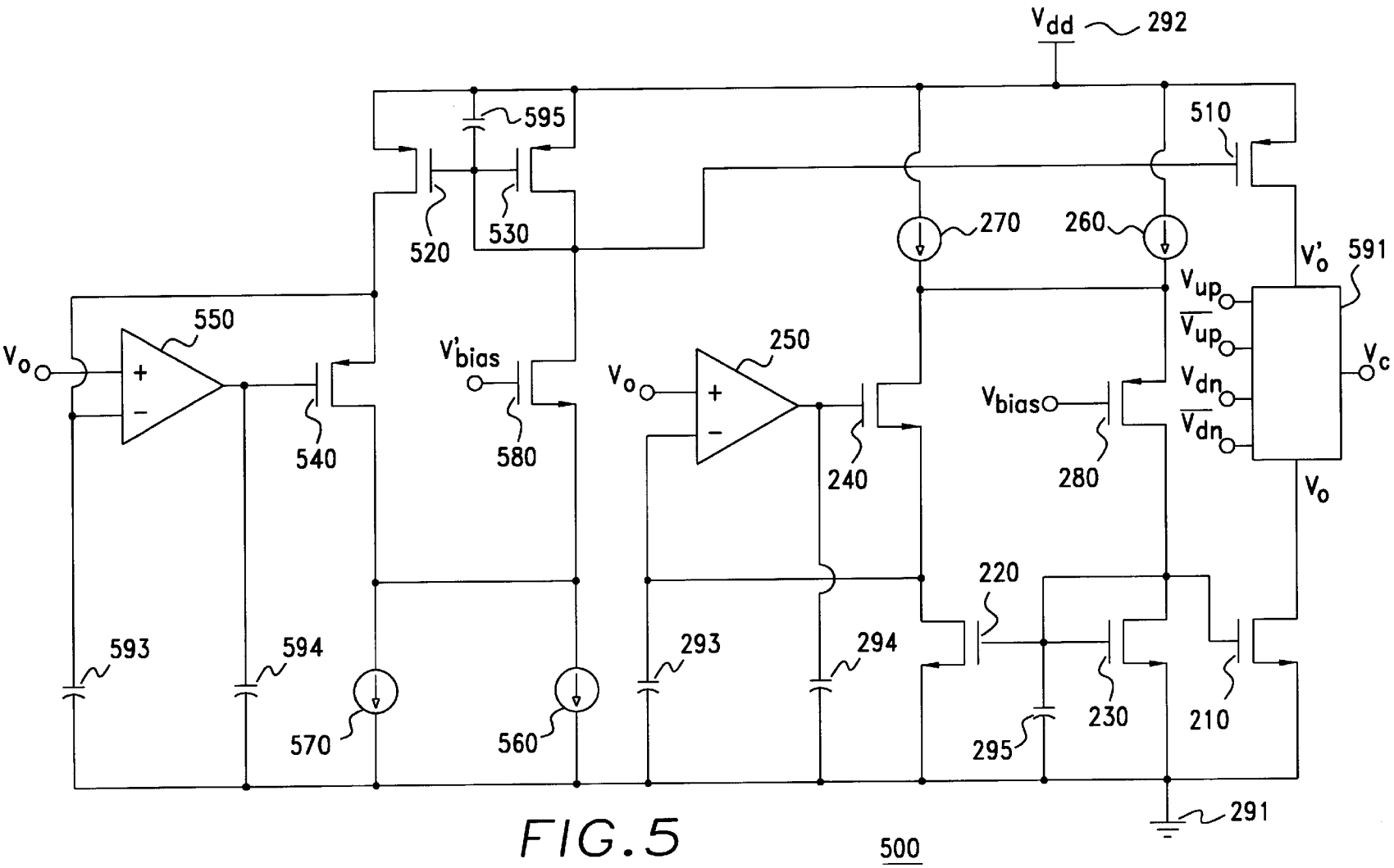
FIG. 5 illustrates a circuit diagram of a larger portion of the integrated circuit of FIG. 1 in accordance with an embodiment of the invention.

FIG. 5 illustrates a circuit diagram of a circuit 500, which is a portion of charge pump 120 in FIG. 1. Circuit 500 in FIG. 5 includes circuit 200 in FIG. 2. In particular, circuit 500 in FIG. 5 comprises three-terminal devices 210, 220, 230, 240, and 280, amplifier 250, capacitors 293, 294, and 295, power supply 292, ground potential 291, and current sources 260 and 270 of circuit 200 in FIG. 2.

Circuit 500 in FIG. 5 further comprises a three-terminal device 580 of the first type. A second terminal, or gate electrode, of device 580 is coupled to a different bias voltage ($V_{bias}$). Circuit 500 further comprises three-terminal devices 510, 520, 530, and 540 of the second type. Circuit 500 additionally comprises an amplifier 550, capacitors 593, 594, and 595, and current sources 560 and 570.

Three-terminal devices 510, 520, 530, 540, and 580, amplifier 550, current sources 560 and 570, and capacitors 593, 594, and 595 provide the up current for charge pump 120 in FIG. 1. These elements of circuit 500 operate in a manner similar to the aforementioned elements of circuit 200, which provide the down current for charge pump 120 of FIG. 1. In particular, devices 510, 520, 530, 540, and 580 in FIG. 5 are similar to devices 210, 220, 230, 240, and 280, respectively, in FIGS. 2 and 5. Similarly, amplifier 550, current sources 560 and 570, and capacitors 593, 594, and 595 in FIG. 5 are similar to amplifier 250, current sources 260 and 270, and capacitors 293, 294, and 295, respectively, in FIGS. 2 and 5.

Circuit 500 of FIG. 5 further comprises a portion 591 that receives the differential up and down voltages ($V_{up}$, $\overline{V}_{up}$, $V_{down}$, and $\overline{V}_{down}$) from phase frequency detector 110 in FIG. 1. Portion 591 in FIG. 5 also provides the output voltages ($V_o$ and $V'_o$) to the down and up current portions of circuit 500. Portion 591 outputs the up and down currents to portion 130 of FIG. 1. Portion 130 of FIG. 1 receives the up and down currents from portion 591 in FIG. 5 and provides the control voltage ($V_c$) to VCO 140. Portion 591 of circuit 500 is not illustrated in detail because it is known in the art.

Therefore, an improved integrated circuit and method of operation is provided to overcome the disadvantages of the prior art. The integrated circuit has an improved or higher current mirror output impedance. The integrated circuit also has a wider dynamic range by improving or reducing the drain-to-source saturation voltages of the output transistors of the current mirror.

Although the invention has been described with reference to specific embodiments, it will be understood by those skilled in the art that various changes may be made without departing from the spirit or scope of the invention. For instance, the numerous details set forth herein such as, for example, the relative sizes of the devices are provided to facilitate the understanding of the invention and are not provided to limit the scope of the invention. As an example, devices 210 and 220 in FIGS. 2 and 3 can be more than five times or less than five times the size of device 230. Devices 210 and 220 can even be equal or smaller in size than device 230. Similar statements can be made about the relative sizes of devices 271 and 261 in FIG. 3. Furthermore, instead of simply electrically shorting together two current sources in FIGS. 2, 3, and 4, a resistor can be inserted in series with the electrical short between the outputs of the two current sources. As an example, the resistor can have a resistance value of approximately one ohm. Moreover, the concepts related to the current mirrors in circuits 200, 300, and 500 can be applied to current mirrors used in other applications. Accordingly, the disclosure of embodiments of the invention is intended to be illustrative of the scope of the invention and is not intended to be limiting. It is intended that the scope of the invention shall be limited only to the extent required by the appended claims.

What is claimed is:

1. An integrated circuit comprising:

a first three-terminal device;

a second three-terminal device;

a third three-terminal device, a first terminal of the third three-terminal device coupled to first terminals of the first and second three-terminal devices, a second terminal of the third three-terminal device coupled to second terminals of the first and second three-terminal devices and to a third terminal of the third three-terminal device;

a fourth three-terminal device;

an amplifier comprising two inputs and an output, a first one of the two inputs coupled to a first terminal of the fourth three-terminal device and to a third terminal of the second three-terminal device, a second one of the two inputs coupled to a third terminal of the first three-terminal device, the output coupled to a second terminal of the fourth three-terminal device;

a first current source comprising an output;

a second current source comprising an output coupled to the output of the first current source and to a third terminal of the fourth three-terminal device; and a fifth three-terminal device, a first terminal of the fifth three-terminal device coupled to the output of the first current source, a third terminal of the fifth three-terminal device coupled to the third terminal of the third three-terminal device.

2. The integrated circuit of claim 1 wherein:

a current flowing from the third terminal of the fifth three-terminal device into the third terminal of the third three-terminal device is approximately equal to a current flowing out of the output of the first current source plus a current flowing out of the output of the second current source minus a current flowing into the third terminal of the fourth three-terminal device.

3. The integrated circuit of claim 1 further comprising:

a capacitor coupling the output of the amplifier to the first terminals of the first, second, and third three-terminal devices.

4. The integrated circuit of claim 1 further comprising:

a capacitor coupling the first terminal of the fourth three-terminal device to the first terminals of the first, second, and third three-terminal devices.

5. The integrated circuit of claim 1 further comprising:

a capacitor coupling the second terminals of the first, second, and third three-terminal devices to the first terminals of the first, second, and third three-terminal devices.

6. The integrated circuit of claim 1 wherein:

the first and second three-terminal devices are larger than the third three-terminal device.

7. The integrated circuit of claim 6 wherein:

the first and second three-terminal devices are approximately five times larger than the third three-terminal device.

8. The integrated circuit of claim 1 wherein:

the first current source generates a current smaller than a current generated by the second current source.

9. The integrated circuit of claim 8 wherein:

the current generated by the first current source is approximately five times smaller than the current generated by the second current source.

10. The integrated circuit of claim 1 wherein:

the first current source comprises:

a sixth three-terminal device, a third terminal of the sixth three-terminal device coupled to the output of the first current source; and the second current source comprises:

a seventh three-terminal device, a third terminal of the seventh three-terminal device coupled to the output of the second current source.

11. The integrated circuit of claim 10 wherein:

the seventh three-terminal device is larger than the sixth three-terminal device.

12. The integrated circuit of claim 11 wherein:

the seventh three-terminal device is approximately five times larger than the sixth three-terminal device.

13. The integrated circuit of claim 1 wherein:

each of the first, second, third, and fourth three-terminal devices is a first type of three-terminal device; and the fifth three-terminal device is a second type of three-terminal device.

14. The integrated circuit of claim 13 wherein:

the first type of three-terminal device is an n-channel MOSFET; and the second type of three-terminal device is a p-channel MOSFET.

15. The integrated circuit of claim 1 wherein:

the first, second, third, fourth, and fifth three-terminal devices, the amplifier, and the first and second current sources form a portion of a phase lock loop.

16. The integrated circuit of claim 15 wherein:

the first, second, third, fourth, and fifth three-terminal devices, the amplifier, and the first and second current sources form a portion of a charge pump in the phase lock loop.

17. An integrated circuit comprising:

a first n-channel MOSFET comprising first source, gate, and drain electrodes;

a second n-channel MOSFET comprising second source, gate, and drain electrodes;

a third n-channel MOSFET comprising third source, gate, and drain electrodes, the first, second, and third source electrodes coupled to each other, the first, second, and third gate electrodes coupled to each other and to the third drain electrode;

a first MOSFET comprising fourth source, gate, and drain electrodes, the fourth source electrode coupled to the second drain electrode;

an amplifier comprising negative and positive inputs and an output, the negative input coupled to the fourth source electrode and to the second drain electrode, the positive input coupled to the first drain electrode, the output coupled to the fourth gate electrode;

a first current source comprising an output coupled to the fourth drain electrode;

a second current source comprising an output coupled to the fourth drain electrode and to the output of the first current source; and a second MOSFET comprising fifth source, gate, and drain electrodes, the fifth source electrode coupled to the outputs of the first and second current sources and to the fourth drain electrode, the fifth drain electrode coupled to the third drain electrode and to the first, second, and third gate electrodes.

18. The integrated circuit of claim 17 further comprising:

a power supply coupled to the first and second current sources; and a ground potential coupled to the first, second, and third source electrodes.

19. The integrated circuit of claim 17 further comprising:

a capacitor coupling the output of the amplifier and the fourth gate electrode to the first, second, and third source electrodes.

20. The integrated circuit of claim 17 further comprising:

a capacitor coupling the negative input of the amplifier, the fourth source electrode, and the second drain electrode to the first, second, and third source electrodes.

21. The integrated circuit of claim 17 further comprising:

a capacitor coupling the first, second, and third gate electrodes and the third and fifth drain electrodes to the first, second, and third source electrodes.

22. The integrated circuit of claim 17 wherein:

the first and second n-channel MOSFETs are equal to or larger than the third n-channel MOSFET.

23. The integrated circuit of claim 22 wherein:

the second current source generates an equal or larger current than the first current source.

24. The integrated circuit of claim 17 wherein:

the first, second, and third n-channel MOSFETs, the amplifier, the first and second MOSFETs, and the first and second current sources form a portion of a phase lock loop.

25. The integrated circuit of claim 24 wherein:

the first, second, and third n-channel MOSFETs, the amplifier, the first and second MOSFETs, and the first and second current sources form a portion of a charge pump in the phase lock loop.

26. The integrated circuit of claim 25 further comprising:

a first capacitor coupling the output of the amplifier and the fourth gate electrode to the first, second, and third source electrodes;

a second capacitor coupling the negative input of the amplifier, the fourth source electrode, and the second drain electrode to the first, second, and third source electrodes; and a third capacitor coupling the first, second, and third gate electrodes and the third and fifth drain electrodes to the first, second, and third source electrodes.

27. The integrated circuit of claim 26 wherein:

the first and second n-channel MOSFETs are equal to or larger than the third n-channel MOSFET by a factor; and the second current source generates a current equal to or larger than a current generated the first current source by the factor.

28. A method of operating an integrated circuit comprising:

providing a first current;

generating a second current to replicate the first current;

generating a reference current;

subtracting the second current from the reference current to create a net current; and adjusting a value of the net current.

29. The method of claim 28 further comprising:

generating a different reference current, wherein:

adjusting the value of the net current further comprises:

adding the net current to the different reference current to create a feedback current.

30. The method of claim 29 wherein:

adjusting the value of the net current further comprises:

adjusting the first and second currents to replicate a version of the feedback current.

31. The method of claim 30 wherein:

adjusting the value of the net current further comprises:

after adjusting the first and second currents, subtracting the second current from the reference current to create a different net current.

32. The method of claim 31 wherein:

adjusting the value of the net current further comprises:

adding the different net current to the different reference current to create a different feedback current.

33. The method of claim 32 wherein:

adjusting the value of the net current further comprises:

adjusting the first and second currents to replicate a version of the different feedback current.

34. The method of claim 31 wherein:

the different net current has a value closer to a predetermined value than the magnitude of the net current.

35. The method of claim 28 wherein:

adjusting the value of the net current further comprises:

if the net current is greater than a predetermined value, increasing the first and second currents; and if the net current is less than the predetermined value, decreasing the first and second currents.

36. The method of claim 35 wherein:

adjusting the value of the net current further comprises:

if the net current is greater than the predetermined value and after increasing the first and second currents, adjusting the value of the net current closer to a predetermined value; and if the net current is less than the predetermined value and after decreasing the first and second currents, adjusting the value of the net current closer to the predetermined value.

37. The integrated circuit of claim 1 wherein:

each of the first, second, and third three-terminal devices is a first type of three terminal device; and each of the fourth and fifth three-terminal devices is a second type of three-terminal device.

* * * * *